US010962275B2

(12) United States Patent
Haddad

(10) Patent No.: US 10,962,275 B2
(45) Date of Patent: Mar. 30, 2021

(54) CONDENSER UNIT WITH FAN

(71) Applicant: Johnson Controls Technology Company, Auburn Hills, MI (US)

(72) Inventor: Robert C. Haddad, Oklahoma City, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 260 days.

(21) Appl. No.: 15/913,309

(22) Filed: Mar. 6, 2018

(65) Prior Publication Data

US 2019/0226747 A1 Jul. 25, 2019

Related U.S. Application Data

(60) Provisional application No. 62/621,981, filed on Jan. 25, 2018.

(51) Int. Cl.

| | |
|---|---|
| ***F04D 29/32*** | (2006.01) |
| ***F25D 17/06*** | (2006.01) |
| ***F25B 39/00*** | (2006.01) |
| ***F24F 1/38*** | (2011.01) |
| ***F24F 1/50*** | (2011.01) |
| *F25B 39/04* | (2006.01) |
| *F25B 13/00* | (2006.01) |
| *F04D 29/38* | (2006.01) |

(52) U.S. Cl.

CPC ..... *F25D 17/067* (2013.01); *F04D 29/326* (2013.01); *F24F 1/38* (2013.01); *F24F 1/50* (2013.01); *F25B 39/00* (2013.01); *F04D 29/386* (2013.01); *F25B 13/00* (2013.01); *F25B 39/04* (2013.01)

(58) Field of Classification Search

CPC .... F04D 29/326; F04D 29/388; F04D 29/386; F04D 29/646; F25D 17/067; F25B 39/04; F24F 1/38

See application file for complete search history.

(56) References Cited

U.S. PATENT DOCUMENTS

| | | | | |
|---|---|---|---|---|
| 855,131 | A * | 5/1907 | Preidel | F04D 3/005 415/221 |
| 987,624 | A * | 3/1911 | Hansen | B64C 9/00 244/51 |
| 4,915,588 | A * | 4/1990 | Brackett | F04D 29/326 416/189 |
| 6,024,537 | A * | 2/2000 | Moreau | F04D 29/326 416/169 A |
| 6,318,104 | B1 * | 11/2001 | Moraes | F24F 1/027 62/262 |
| 6,357,249 | B1 | 3/2002 | Robinson et al. | |

(Continued)

FOREIGN PATENT DOCUMENTS

| | | | |
|---|---|---|---|
| EP | 3064776 | A1 | 9/2016 |
| WO | 2006078083 | A2 | 7/2006 |
| WO | 2016190754 | A1 | 12/2016 |

*Primary Examiner* — Nathaniel E Wiehe
*Assistant Examiner* — Wesley Le Fisher
(74) *Attorney, Agent, or Firm* — Fletcher Yoder, P.C.

(57) ABSTRACT

A heating, ventilating, and air conditioning (HVAC) system that includes a fan. The fan includes a plurality of blades coupled to a hub. A shroud is coupled to the plurality of blades, wherein the shroud focuses a flow of air along a rotational axis of the fan and reduces the flow of the air radially outward from the fan.

19 Claims, 8 Drawing Sheets

(56) References Cited

U.S. PATENT DOCUMENTS

| | | | | |
|---|---|---|---|---|
| 6,370,899 | B1 | 4/2002 | Hobbs et al. | |
| 6,626,640 | B2 * | 9/2003 | Ivanovic | F04D 29/384 415/142 |
| 9,416,997 | B1 | 8/2016 | Bush, Jr. et al. | |
| 2003/0084682 | A1 | 5/2003 | Choi | |
| 2004/0165986 | A1 * | 8/2004 | Parker | F04D 29/164 415/220 |
| 2012/0108161 | A1 * | 5/2012 | Choi | F04D 29/164 454/341 |
| 2013/0115087 | A1 * | 5/2013 | Olmo | F04D 29/326 416/189 |
| 2013/0209242 | A1 * | 8/2013 | Ota | F04D 29/164 415/185 |
| 2015/0330223 | A1 * | 11/2015 | Choi | F04D 29/329 416/204 R |
| 2018/0320705 | A1 * | 11/2018 | Van Houten | F04D 29/388 |
| 2019/0184786 | A1 * | 6/2019 | Stauter | B60H 1/00464 |

* cited by examiner

CONDENSER UNIT WITH FAN

CROSS-REFERENCE TO RELATED APPLICATION

This application is a Non-Provisional Application claiming priority to U.S. Provisional Application No. 62/621,981, entitled "CONDENSER UNIT WITH FAN," filed Jan. 25, 2018, which is hereby incorporated by reference in its entirety for all purposes.

BACKGROUND

The disclosure relates generally to HVAC systems.

Heating, ventilation, and air conditioning (HVAC) systems condition enclosed spaces by exchanging energy between a refrigerant and air. HVAC systems accomplish this by circulating a refrigerant between two heat exchangers commonly referred to as an evaporator coil and a condenser coil. As refrigerant passes through the evaporator coil and the condenser coil, the refrigerant either absorbs or discharges thermal energy. More specifically, as air passes over the evaporator coil, the air cools as it loses energy to the refrigerant passing through the evaporator coil. In contrast, the condenser coil enables the refrigerant to discharge heat into the atmosphere as air flows over the condenser coil.

SUMMARY

The present disclosure relates to a heating, ventilating, and air conditioning (HVAC) system that includes a fan. The fan includes a plurality of blades coupled to a hub. A shroud is coupled to the plurality of blades, wherein the shroud focuses a flow of air along a rotational axis of the fan and reduces the flow of the air radially outward from the fan.

The present disclosure also relates to a condenser system. The condenser system includes a fan that draws a fluid through a heat exchanger and ejects the fluid from the condenser system. The fan includes a plurality of blades coupled to a hub. An axial shroud coupled to the blades, wherein the axial shroud extends about an entire circumference of the fan and is configured to focus a flow of the fluid along an axis of the fan and reduce the flow of the fluid radially outward from the fan.

The present disclosure further relates to a fan that draws a fluid through a heat exchanger and ejects the fluid from a condenser unit. The fan includes a plurality of blades coupled to a hub. A shroud coupled to the blades, wherein the shroud focuses a flow of the fluid along an axis of the fan and reduces the flow of the fluid radially outward from the fan. A winglet is coupled to the shroud and extends radially outward from the shroud, wherein the winglet is configured to force the fluid radially inward into the fan.

DRAWINGS

DETAILED DESCRIPTION

Embodiments of the present disclosure include an HVAC system with a condenser fan that facilitates heat transfer from the condenser coil. As described in more detail below, the condenser fan includes a shroud or wall that couples to the fan blades. In operation, the shroud or wall focuses or directs airflow out of the condenser system to reduce and/or block the backflow of air through the condenser coil caused by centrifugal forces of the rotating fan. More specifically, the fan focuses or directs airflow along the axis of the fan, which reduces and/or blocks the fan from blowing air perpendicularly to the fan caused by centrifugal forces during operation.

Figure 1:
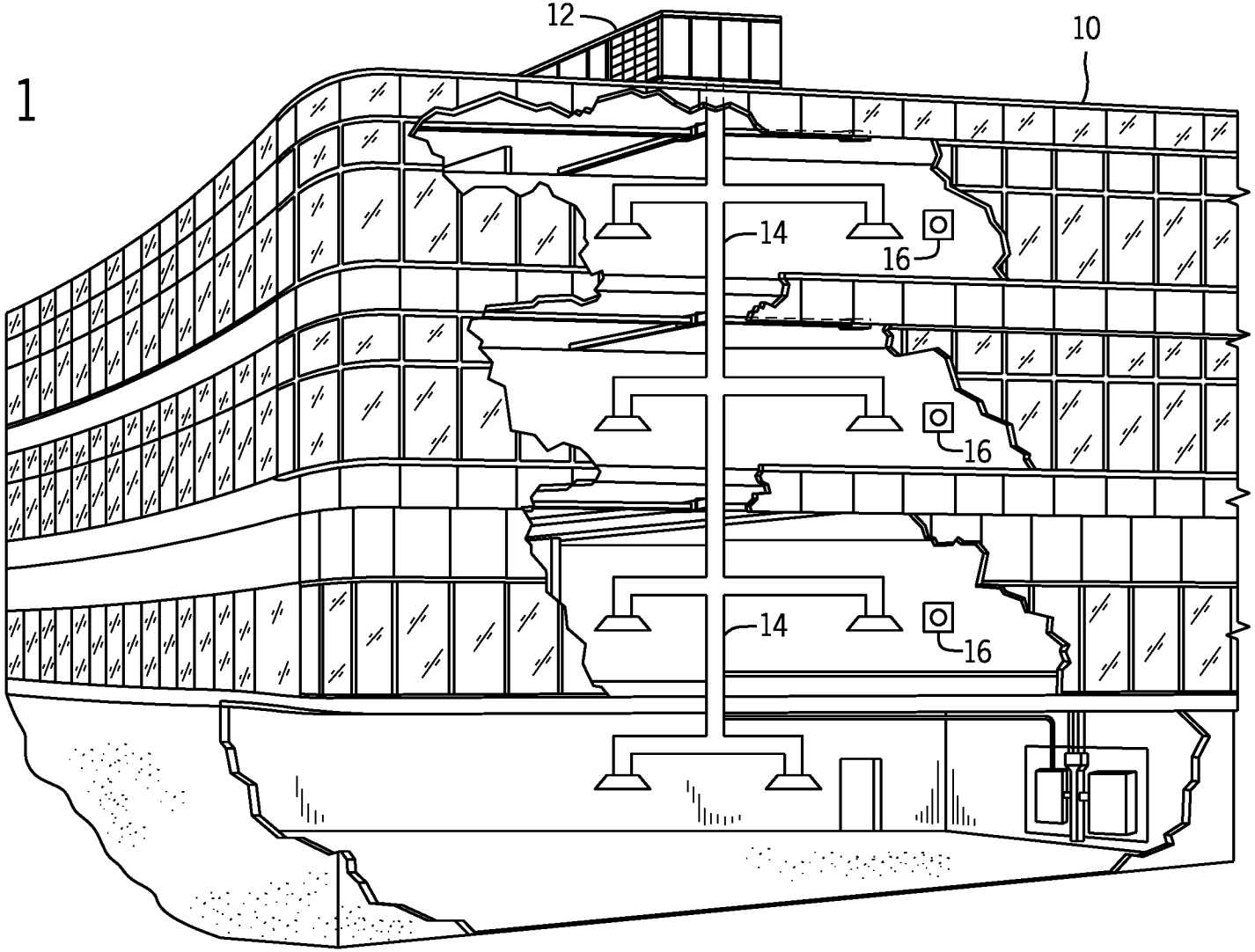
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply airstream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an airstream and a furnace for heating the airstream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
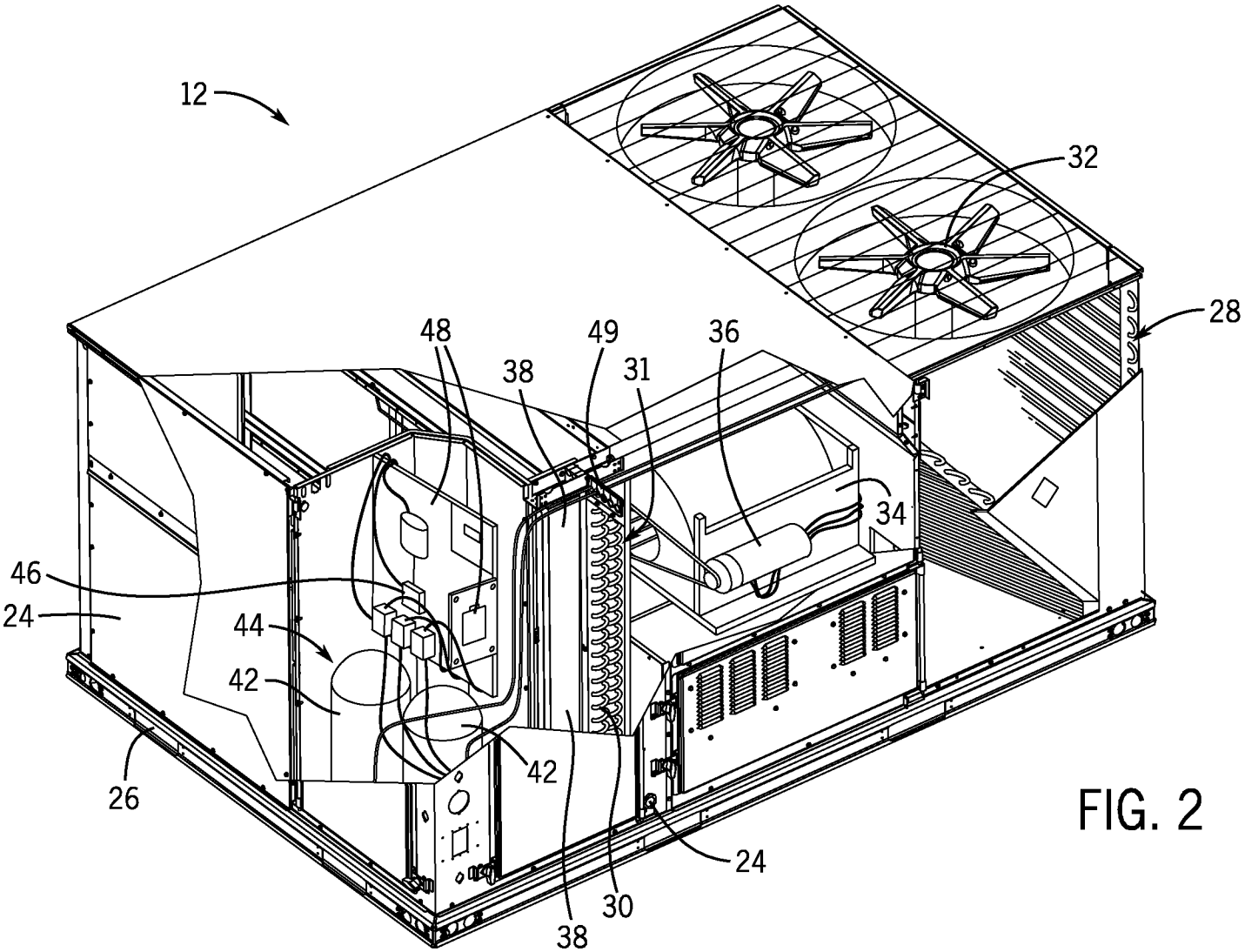
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an airstream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an airstream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the airstream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
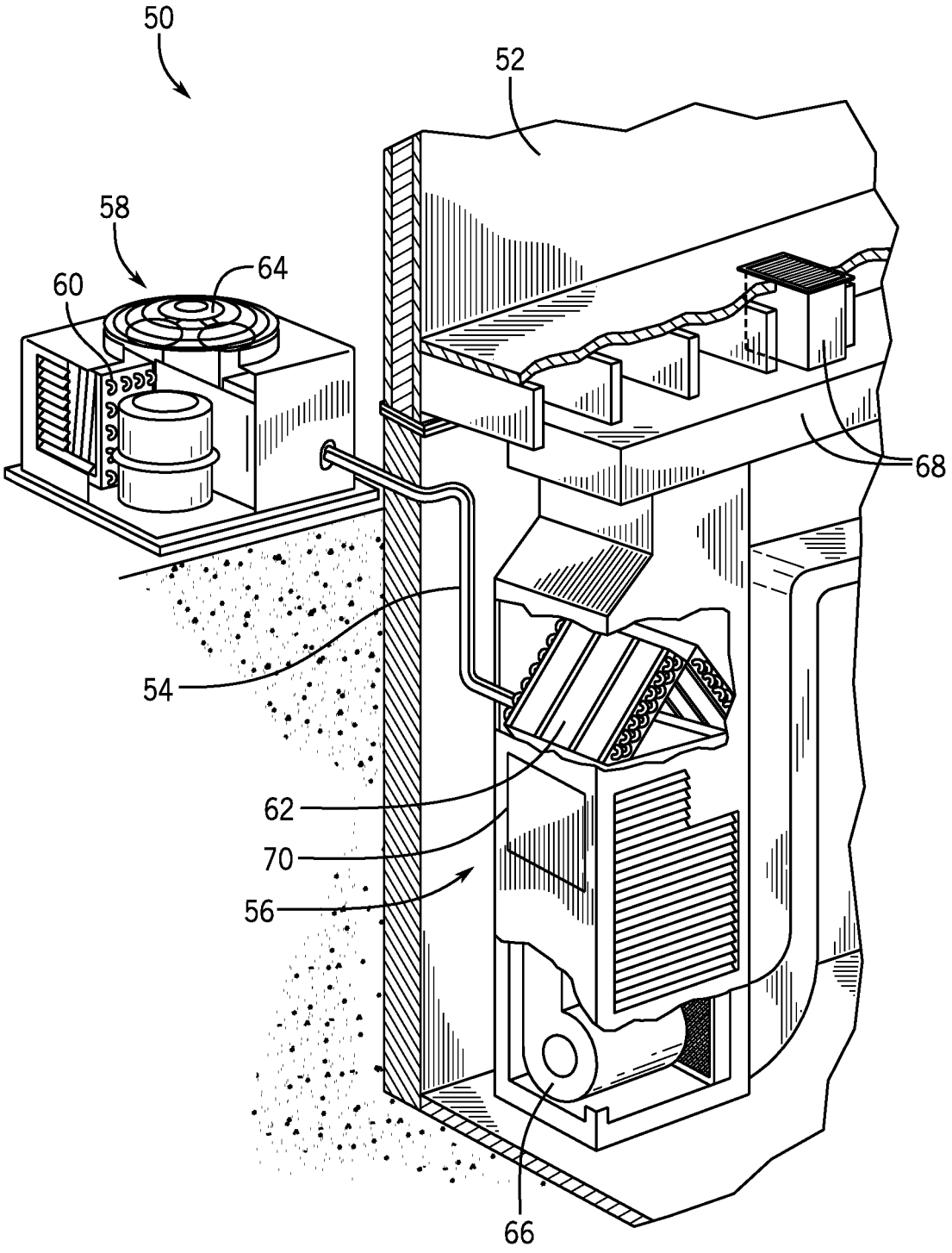
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 72. For example, the indoor unit 56 may include the furnace system 72 when the residential heating and cooling system 50 is not configured to operate as a heat pump. The furnace system 72 may include a burner assembly and heat exchanger, among other components, inside the indoor unit 56. Fuel is provided to the burner assembly of the furnace 72 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 72 to the ductwork for heating the residence 52.

Figure 4:
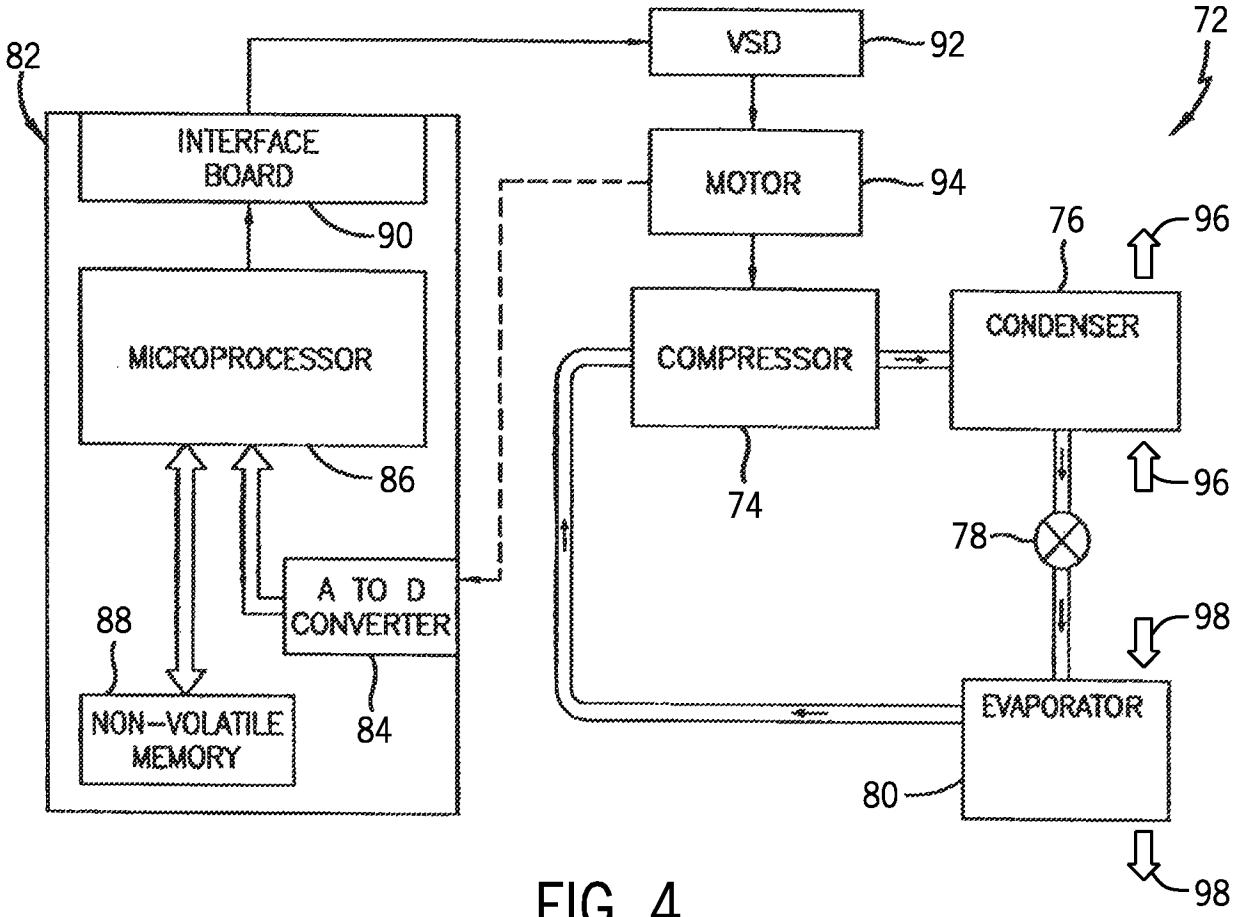
FIG. 4 is a schematic of an embodiment of an HVAC system, in accordance with an aspect of the present disclosure.

FIG. 4 is an embodiment of a vapor compression system 71 that can be used in any of the systems described above. The vapor compression system 71 may circulate a refrigerant through a circuit starting with a compressor 74. The circuit may also include a condenser 76, an expansion valve(s) or device(s) 78, and an evaporator 80. The vapor compression system 71 may further include a control panel 82 that has an analog to digital (A/D) converter 84, a microprocessor 86, a non-volatile memory 88, and/or an interface board 90. The control panel 82 and its components may function to regulate operation of the vapor compression system 71 based on feedback from an operator, from sensors of the vapor compression system 71 that detect operating conditions, and so forth.

In some embodiments, the vapor compression system 71 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another airstream, such as a supply airstream 98 provided to the building 10 or the residence 52. For example, the supply airstream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply airstream 98 via thermal heat transfer with the refrigerant. Thereafter, the vapor refrigerant exits the evaporator 80 and returns to the compressor 74 by a suction line to complete the cycle.

In some embodiments, the vapor compression system 71 may further include a reheat coil in addition to the evaporator 80. For example, the reheat coil may be positioned downstream of the evaporator relative to the supply airstream 98 and may reheat the supply airstream 98 when the supply airstream 98 is overcooled to remove humidity from the supply airstream 98 before the supply airstream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply airstream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
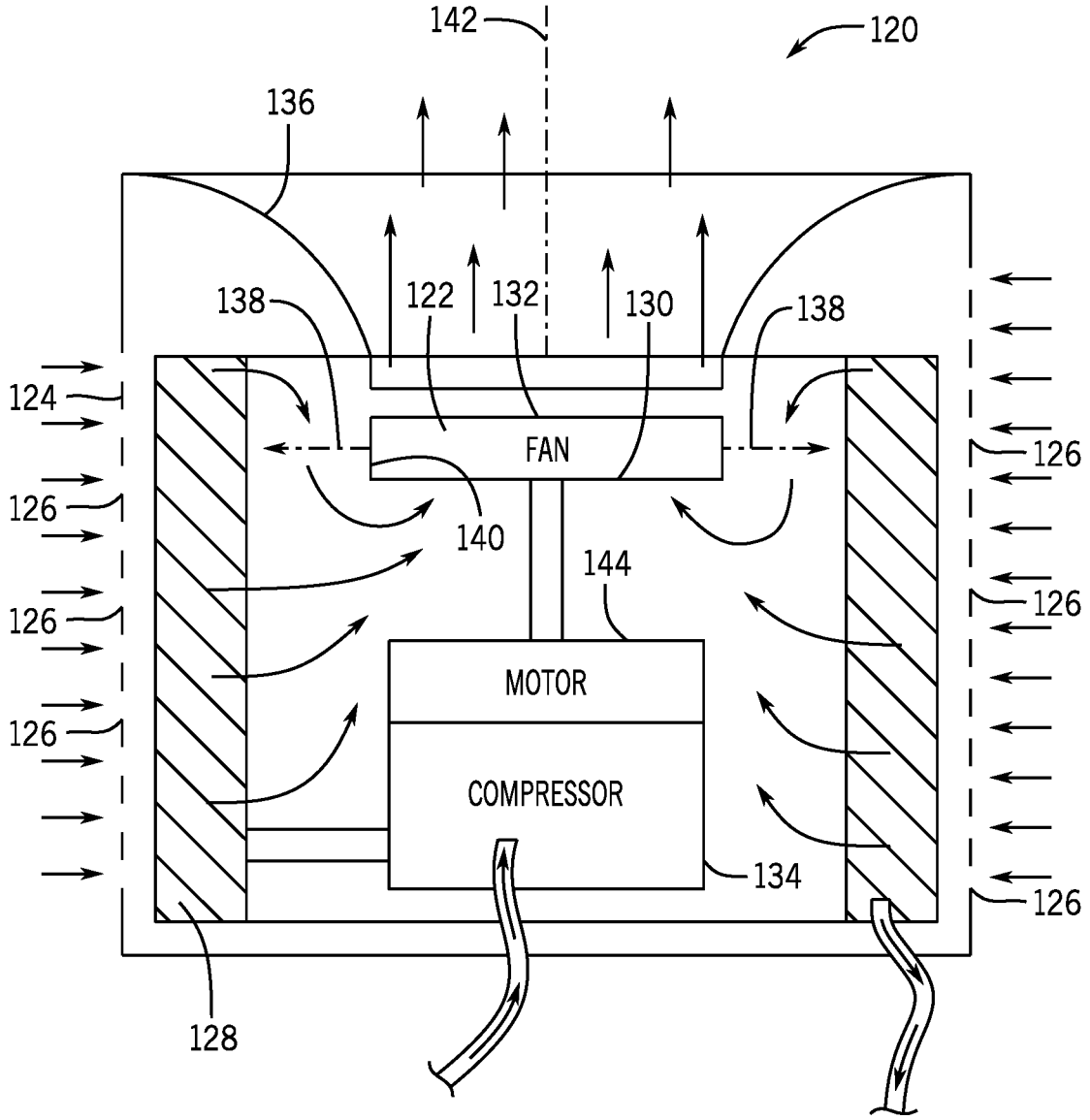
FIG. 5 is a cross-sectional side view of an embodiment of a condenser system with a fan, in accordance with an aspect of the present disclosure.

FIG. 5 is a cross-sectional side view of a condenser system 120 with a fan 122. As explained above, HVAC systems operate by pumping a refrigerant between heat exchangers to absorb energy from air inside of a building and then to reject that energy into air outside of the building. These heat exchangers are housed in separate systems sometimes referred to as an evaporator system, indoor unit, or evaporator unit, which contains one of the heat exchangers called an evaporator coil, and another system referred to as the condenser system, outdoor unit, or condenser unit that contains the other heat exchanger also called a condenser coil. The condenser system 120 is typically housed within a housing or container 124, such as a metal container. The container 124 includes a plurality of apertures 126 that enable air to flow through the container 124 to exchange energy with a condenser coil 128. To facilitate movement of air across/through the condenser coil 128, the condenser system 120 includes the fan 122. As the fan 122 rotates, it draws air to a first side 130 of the fan 122 and then blows the air out of a second side 132 of the fan 122. In this way, the fan 122 draws air into the container 124 and across the condenser coil 128 where the air absorbs energy from the refrigerant.

Refrigerant is pumped into the condenser coil 128 with a compressor 134 that receives hot refrigerant from the indoor unit. As explained above, the refrigerant increases in temperatures as it loses energy to air circulating in the building. As the compressor 134 pumps the hot refrigerant, the hot refrigerant circulates through the condenser coil 128 where it exchanges energy with air flowing over the condenser coil 128. As the air flows across the condenser coil 128, the air warms before it is captured by the fan 122 and is subsequently discharged from the condenser system 120 through an outlet 136. It may be undesirable to blow this warmed air back over the condenser coil 128, or a portion thereof. To block the flow of air radially outward from the fan 122 in radial directions 138, the fan 122 includes a shroud or wall 140 that couples to and surrounds one or more blades of the fan 122. In operation, the shroud or wall 140 focuses and/or directs the flow of air axially through the fan 122 along axis/direction 142, thus reducing and/or blocking the flow of air radially outwards in response to centrifugal forces created by rotation of the fan 122. In this way, the fan 122 may facilitate heat transfer from the condenser coil 128 by continuously drawing a fresh stream of air over the condenser coil 128.

The fan 122 may rotate clockwise or counterclockwise depending on the orientation of the blades to draw air across the condenser coil 128 and then discharge the warmed air out of the condenser system 120. The fan 122 is driven with a motor 144. In some embodiments, the motor 144 may be a variable speed drive motor that enables the fan 122 to rotate at different speeds.

Figure 6:
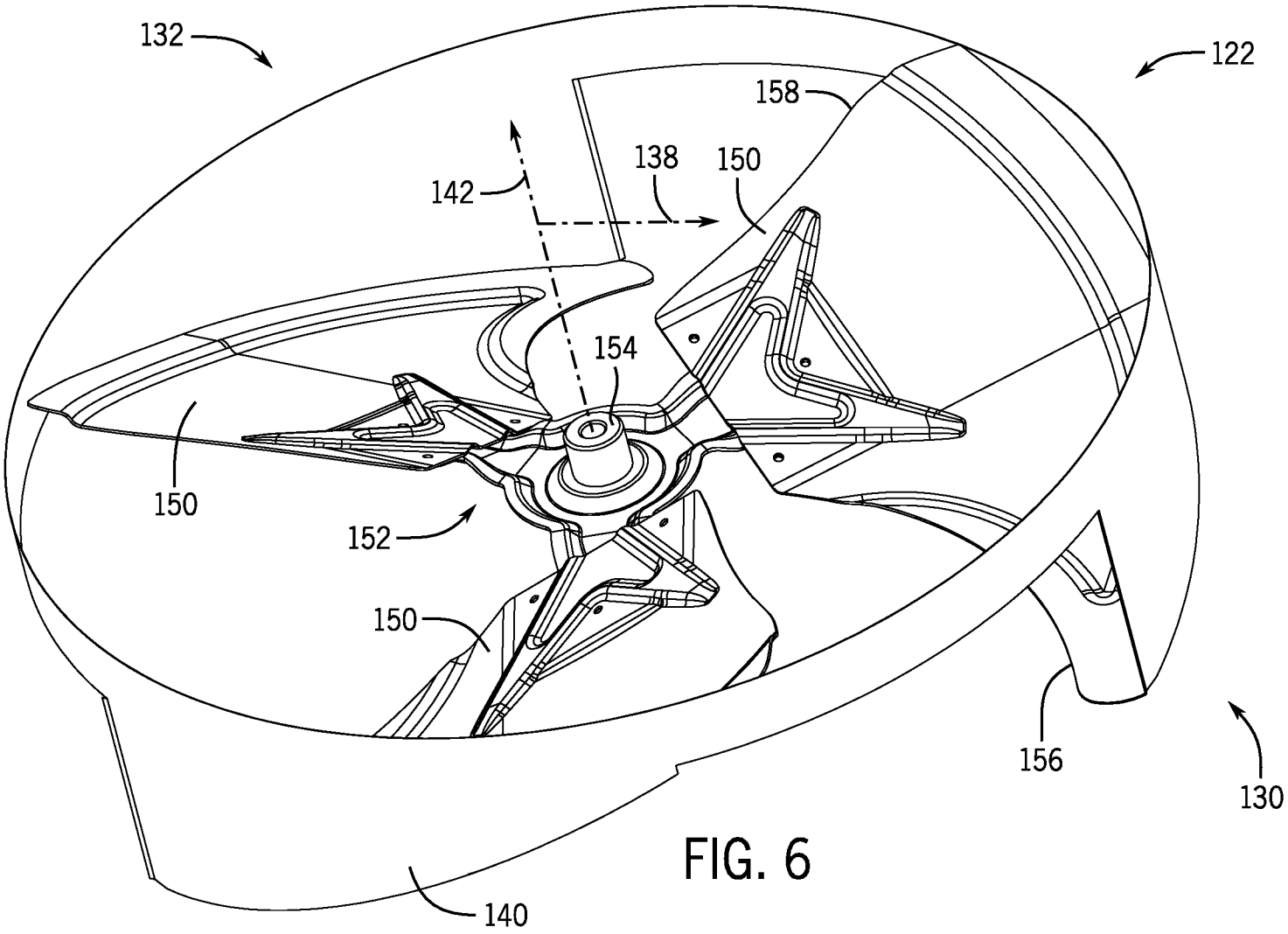
FIG. 6 is a perspective top view of an embodiment of the fan in FIG. 5, in accordance with an aspect of the present disclosure.

FIG. 6 is a perspective top view of and embodiment of the fan 122 in FIG. 5. As illustrated, the fan 122 includes fan blades 150 that couple to a hub 152 and to the shroud or wall 140. The hub 152 includes a cylinder 154 that enables attachment of the fan 122 to a shaft of the motor 144. The fan 122 may be formed from a single undivided piece of material, such as by casting or an additive manufacturing process. In other words, the fan 122 may not include multiple pieces that are assembled to form the fan 122. However, in some embodiments the fan 122 may be formed of different pieces that are then assembled together. For example, the shroud 140, blades 150, and hub 152 may be formed separately and then coupled together by welding, rivets, or another joining technique.

In FIG. 6, the fan 122 includes three blades 150. However, it should be understood that the fan 122 may include a different number of blades 150, such as 2, 4, 5, or more. The blades 150 are wing swept blades that angle upwards from the first side 130 to the second side 132 of the fan 122. As the fan 122 rotates, the blades 150 scoop up air and propel it in axial direction 142. More specifically, as the blades rotate 150, a leading edge 156 scoops air that is then lifted by the rest of the blade 150 from the first side 130 of the fan 122 to the second side 132 of the fan 122. In other words, the fan 122 may guide the air from the leading edge 156 of the blade 150 to the trailing edge 158 as the fan 122 rotates. During operation, the centrifugal force generated by the rotating blades 150 may drive the air radially outwards in radial direction 138. In order to focus and direct the air in axial direction 142, and thus reduce blowing some air radially outward, the fan 122 includes the shroud 140, that is an axial shroud.

Figure 7:
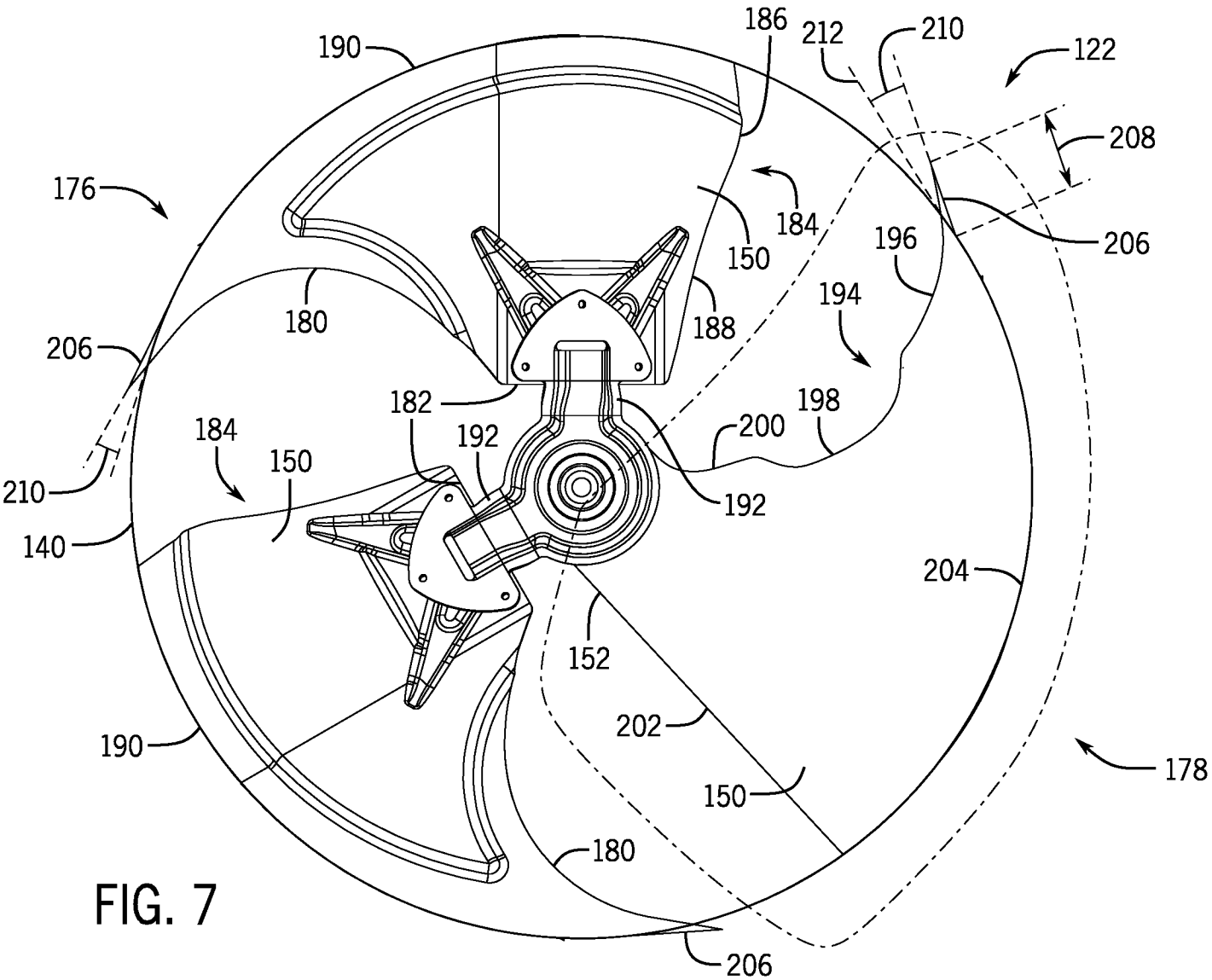
FIG. 7 is a top view of an embodiment of the fan in FIG. 5, in accordance with an aspect of the present disclosure.

FIG. 7 is a perspective top view of an embodiment of the fan 122 in FIG. 5. As illustrated, the fan blades 150 may have a variety of shapes. A first blade shape 176 is illustrated outside of the dashed lines and a second blade shape 178 is illustrated within the dashed lines. All of the fan blades 150 may have either the first blade shape 176, the second blade shape 178, or another blade shape. In some embodiments, the fan 122 may include a combination of differently shaped blades 150.

The first blade shape 176 includes a curved leading edge 180. The curved leading edge 180 makes a continuous curve until it joins with an inner edge 182. In some embodiments, the entire inner edge 182 is straight and facilitates coupling to the hub 152. In some embodiments, a trailing edge 184 of the first blade shape 176 includes both a curved portion 186 and a straight portion 188. The curved portion 186 extends from the shroud 140 before gradually tapering into the straight portion 188. An outer edge 190 of the blade 150 couples to the shroud 140 and curves with the same radius of curvature as the shroud 140. As illustrated, the outer edge 190 also couples to the shroud 140 from the leading edge 180 to the trailing edge 184. In some embodiments, the hub 152 may include arms 192 that extend away from the hub 152 to facilitate coupling with the inner edge 182 of the fan blade 150.

The second blade shape 178 is illustrated within the dashed line of FIG. 7. The second blade shape 178 includes a curved leading edge 194. The curved leading edge 194 includes three different curved portions 196, 198, and 200. The first curved portion 196 curves from the shroud 140 to the second curved portion 198. The second curved portion 198 curves into the fan blade 150 forming a groove in the leading edge 194 and fan blade 150. Coupled to the second curved portion 198 is the third curved portion 200, which extends from the second curved portion 198 to the hub 152. As illustrated, the hub 152 and blade 150 may be one-piece that is not formed from separate pieces and then joined. However, in some embodiments, the hub 152 and fan blade 150 may be separate pieces that are later joined to one another. The second blade shape 178 has a straight trailing edge 202 that extends from the shroud 140 to the hub 152. However, in other embodiments, the trailing edge 202 may be curved or have both straight and curved portions. The outer edge 204 of the blade 150 couples to the shroud 140 and curves with the same radius of curvature as the shroud 140. As illustrated, the outer edge 204 also couples to the shroud 140 from the leading edge 194 to the trailing edge 202.

In some embodiments, the fan 122 may include winglets 206 that facilitate drawing air into the fan 122. This enables the fan 122 to both draw air from below the fan 122 as well as air about the circumference of the fan 122. The winglets 206 may extend a distance 208 from the shroud 140. The distance 208 may be approximately 0.5 inches or less. Distances greater than 0.5 inches may create turbulence that destabilizes the fan 122. The winglets 206 may also form an angle 210 with respect to a tangent 212 of the shroud 140. The angle 210 may be between 1-30 degrees. This angle range may facilitate capturing additional amounts of air by the fan 122 without forming significant turbulence or resistance to rotation.

Figure 8:
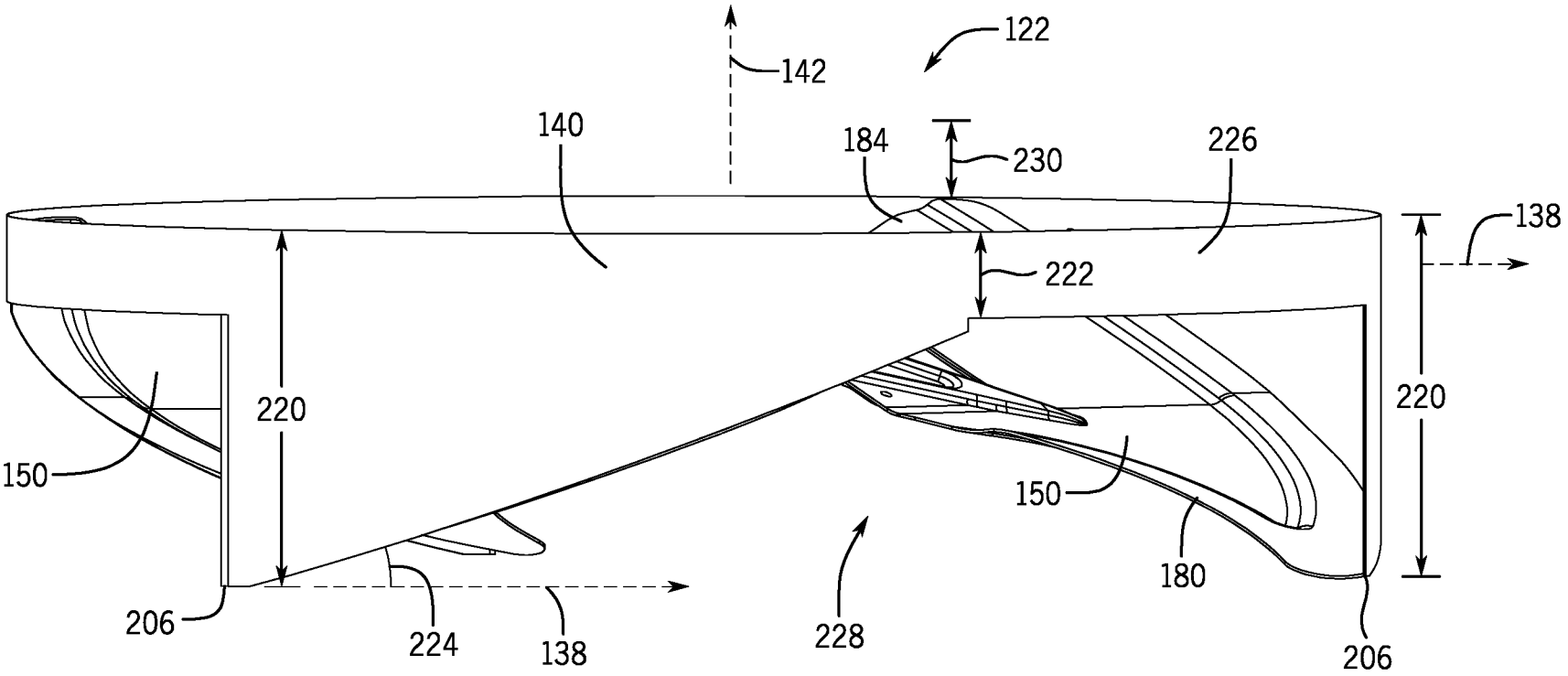
FIG. 8 is a side view of an embodiment of the fan in FIG. 5, in accordance with an aspect of the present disclosure.

FIG. 8 is a side view of the fan 122 in FIG. 5. As explained above, as the fan 122 rotates the blades 150 scoop up air and propel it in axial direction 142. However, the centrifugal force generated by the rotating blades 150 may drive the air radially outwards in radial direction 138. In order to focus the air in axial direction 142 and thus reduce blowing air radially outward from the axis 142, the fan 122 includes the shroud 140. The shroud 140 extends about the circumference of the fan 122. In some embodiments, the height of the shroud 140 may be uniform about the circumference. In other embodiments, the height of the shroud 140 may vary.

FIG. 8 illustrates an embodiment of the fan 122 with a shroud 140 that changes in height about the circumference of the fan 122. As illustrated, the shroud 140 defines a maximum height 220 where the leading edge 180 couples to the shroud 140. The height of the shroud 140 then tapers to a second height 222 proximate to or where the trailing edge 184 couples to the shroud 140. In some embodiments, the changing height of the shroud 140 may therefore be related to an angle of attack 224 of the fan blade 150 with respect to the radial direction 138. In this way, the height of the shroud 140 may extend from the leading edge 180 of the fan blade 150 to the trailing edge 184 of the fan blade 150 to block or reduce airflow flowing over the blade 150 from flowing in radial direction 138.

As illustrated, the fan 122 may include a shroud portion 226 with a uniform height that is less than the maximum height 220. This shroud portion 226 may extend uniformly about a portion of the fan's circumference. In this way, the fan 122 may define windows 228 in between the blades 150. These windows 228 may facilitate the capture of air by the winglet 206 as the fan 122 rotates, thus enabling the winglet 206 to direct air into the fan 122 where it is scooped up by the fan blade 150. In some embodiments, the windows 228 may extend between leading edges 180 of neighboring fan blades 150 in order to maximize the size of the windows 228 to receive air. In some embodiments, the shroud 140 may extend a distance 230 above the trailing edge 184 in axial direction 142 in order to focus the airflow from the fan 122 in axial direction 142. For example, the distance 230 may extend approximately 1 inch above the trailing edge 184 of the fan 122.

Only certain features and embodiments of the disclosure have been illustrated and described, many modifications and changes may occur to those skilled in the art without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed subject matter. It should be appreciated that in the development of any such actual implementation, as in any engineering or design project, numerous implementation specific decisions may be made. Such a development effort might be complex and time consuming, but would be a routine undertaking of design, fabrication, and manufacture for those of ordinary skill having the benefit of this disclosure, without undue experimentation.

The invention claimed is:

1. A heating, ventilating, and air conditioning (HVAC) system, comprising:

a fan configured to direct air within the HVAC system, comprising:

a plurality of blades coupled to a hub, wherein each blade of the plurality of blades comprises a leading edge;

a shroud fixed to the plurality of blades, wherein the shroud comprises a plurality of openings formed about a circumference of the shroud, wherein the shroud is configured to rotate with the plurality of blades to focus a flow of air along a rotational axis of the fan and reduce the flow of the air radially outward from the fan; and a plurality of winglets, wherein each winglet of the plurality of winglets extends from a respective leading edge of a respective blade of the plurality of blades and is configured to direct air radially inward through a respective opening of the plurality of openings to the respective blade of plurality of blades, and wherein each winglet of the plurality of winglets extends radially outward from the shroud.

2. The system of the claim 1, wherein the shroud extends about an entire circumference of the fan.

3. The system of claim 1, wherein a height of the shroud varies about a circumference of the fan.

4. The system of claim 1, wherein each blade of the plurality of blades comprises a wing swept blade.

5. The system of claim 1, wherein the plurality of blades comprises three blades.

6. The system of claim 1, wherein the shroud defines a first height at the respective leading edge of each blade of the plurality of blades and a second height at a respective trailing edge of each blade of the plurality of blades, and wherein the first height is greater than the second height.

7. The system of claim 1, wherein each blade of the plurality of blades defines a first length at the leading edge and a second length at a respective trailing edge of the blade, and wherein the first length is greater than the second length.

8. The system of claim 1, wherein the leading edge defines a curved leading edge.

9. The system of claim 1, wherein each blade of the plurality of blades continuously curves between the leading edge and a respective trailing edge of the blade.

10. The system of claim 1, wherein the plurality of blades and the shroud are a single piece.

11. The system of claim 1, comprising a condenser unit having the fan.

12. A condenser system, comprising:

a fan configured to draw a fluid through a heat exchanger and eject the fluid from the condenser system, wherein the fan comprises:

a plurality of blades coupled to a hub;

an axial shroud fixed to the plurality of blades, wherein the axial shroud extends about an entire circumference of the fan and comprises a plurality of openings, and wherein the axial shroud is configured to rotate with the plurality of blades and to focus a flow of the fluid along an axis of the fan and reduce the flow of the fluid radially outward from the fan; and a plurality of winglets, wherein each winglet of the plurality of winglets extends radially outward from the axis of the fan and from the axial shroud and is configured to direct air radially inward through a respective opening of the plurality of openings into the fan.

13. The system of claim 12, wherein a height of the axial shroud changes about the circumference of the fan.

14. The system of claim 12, wherein the axial shroud defines a first height at a respective leading edge of each blade of the plurality of blades and a second height at a respective trailing edge of each blade of the plurality of blades, and wherein the first height is greater than the second height.

15. The system of claim 12, wherein each blade of the plurality of blades defines a first length at a respective leading edge and a second length at a respective trailing edge, and wherein the first length is greater than the second length.

16. A fan configured to draw a fluid through a heat exchanger and eject the fluid from a condenser unit, wherein the fan comprises:

a plurality of blades coupled to a hub;

a shroud fixed to the plurality of blades, wherein the shroud comprises one or more openings, and wherein the shroud is configured to rotate with the plurality of blades and focus a flow of the fluid along an axis of the fan and reduce the flow of the fluid radially outward from the fan; and a winglet coupled to the shroud and extended radially outward from the axis of the fan and from the shroud, wherein the winglet is configured to force the fluid radially inward into the one or more openings of the shroud.

17. The fan of claim 16, wherein the shroud defines a first height at a respective leading edge of each blade of the plurality of blades and a second height at a respective trailing edge of each blade of the plurality of blades, and wherein the first height is greater than the second height.

18. The fan of claim 16, wherein the plurality of blades comprises wing swept blades.

19. The fan of claim 16, wherein each blade of the plurality of blades defines a first length at a respective leading edge and a second length at a respective trailing edge, and wherein the first length is greater than the second length.

* * * * *